US009541249B2

(12) United States Patent
Sekiguchi et al.

(10) Patent No.: US 9,541,249 B2
(45) Date of Patent: Jan. 10, 2017

(54) VEHICLE LIGHTING UNIT

(71) Applicant: Stanley Electric Co., Ltd., Tokyo (JP)

(72) Inventors: Tatsuya Sekiguchi, Tokyo (JP); Satoshi Shikata, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 254 days.

(21) Appl. No.: 14/556,405

(22) Filed: Dec. 1, 2014

(65) Prior Publication Data

US 2015/0159826 A1 Jun. 11, 2015

(30) Foreign Application Priority Data

Dec. 5, 2013 (JP) ..... 2013-251632

(51) Int. Cl.
*F21S 8/10* (2006.01)

(52) U.S. Cl.
CPC ..... *F21S 48/1388* (2013.01); *F21S 48/1104* (2013.01); *F21S 48/1159* (2013.01); *F21S 48/1225* (2013.01); *F21S 48/137* (2013.01); *F21S 48/1323* (2013.01); *F21S 48/1382* (2013.01); *F21S 48/142* (2013.01); *F21S 48/145* (2013.01); *F21S 48/15* (2013.01); *F21S 48/1747* (2013.01)

(58) Field of Classification Search
None
See application file for complete search history.

(56) References Cited

U.S. PATENT DOCUMENTS

2004/0252517 A1 12/2004 Ishida et al.
2006/0087860 A1* 4/2006 Ishida ..... F21S 48/1159 362/517

FOREIGN PATENT DOCUMENTS

EP 2 881 649 A1 6/2015
JP 2004-303639 A 10/2004

* cited by examiner

*Primary Examiner* — Sharon Payne
(74) *Attorney, Agent, or Firm* — Kenealy Vaidya LLP

(57) ABSTRACT

A vehicle lighting unit can effectively utilize both the portions of the reflector divided by the plane passing through the optical axis even when a light emitting element with directionality like an LED is employed as well as can be provided with an enhanced aesthetic feature. The vehicle lighting unit can include a reflector having, as a front surface, a concave reflecting surface formed on the basis of a revolved parabolic surface with respect to an optical axis serving as a rotational symmetric axis; a reflecting plate disposed along the optical axis in front of the reflecting surface and having a rear edge disposed at or near the focal point of the reflecting surface so as to vertically divide a space in front of the reflecting surface into two regions; a light emitting element disposed in the upper region than the reflecting plate and in front of the focal point, directed to the focal point; and a condenser lens disposed between the light emitting element and the focal point, configured to collect light emitted from the light emitting element to a position at or near the focal point.

4 Claims, 12 Drawing Sheets

VEHICLE LIGHTING UNIT

This application claims the priority benefit under 35 U.S.C. §119 of Japanese Patent Application No. 2013-251632 filed on Dec. 5, 2013, which is hereby incorporated in its entirety by reference.

TECHNICAL FIELD

The presently disclosed subject matter relates to a vehicle lighting unit for use in vehicle headlamps and the like.

BACKGROUND ART

Some of reflector-type vehicle lighting units can include a light source and a parabolic reflector having a focal point at or near the light source. Typical conventional light sources can adopt a bulb, but main stream has been to use a light emitting diode. This concept has been disclosed in Japanese Patent Application Laid-Open No. 2004-303639 or US2004/0252517A1, for example (which will be referred to as Patent Literature 1 hereinafter). A bulb can have an emission light source of a filament or a discharge unit, and can emit light from the emission light source radially in all directions. On the contrary, a light emitting diode can emit light with directionality. In other words, the optical axis of such a light emitting diode is directed in a direction in which the light emitting diode is disposed (directed). The light is radially emitted with the optical axis direction as a center, but no light is emitted in the opposite direction.

The vehicle lighting unit described in Patent Literature 1 includes one parabolic reflector (18) per one light emitting diode (16). The light emitting diode (16) is disposed at or near the focal point of the parabolic reflector (18) so that the light emitting diode is directed rightward when viewed from its front side. Thus, the light emission direction of the light emitting diode (16) is the right direction. Further, the parabolic reflector (18) is disposed so as to be spread from the light emitting diode (16) rightward. Since the light emitted from the light emitting diode (16) does not travel leftward, the parabolic reflector (18) is not provided on the left side of the light emitting diode (16) (on the side opposite to the light emitting direction of the light emitting diode (16)).

Even if the parabolic reflector (18) is provided with a leftward extending portion with respect to the light emitting diode (16) when viewed from its front side, the light emitted from the light emitting diode (16) can be reflected by the right portion of the parabolic reflector (18), but cannot be reflected by the left portion of the parabolic reflector (18). Accordingly, if the parabolic reflector (18) is provided with the left portion on the left side of the light emitting diode (16), when the parabolic reflector (18) is divided to right and left portions with respect to the vertical plane passing through the optical axis of the parabolic reflector (18), the left portion of the parabolic reflector (18) cannot be utilized effectively in a case where a single light emitting diode (16) is employed.

SUMMARY

The presently disclosed subject matter was devised in view of these and other problems and features in association with the conventional art. According to one aspect of the presently disclosed subject matter, a vehicle lighting unit can effectively utilize both the portions of the reflector divided by the plane passing through the optical axis even when a light emitting element with directionality like an LED is employed as well as can be provided with an enhanced aesthetic feature.

According to another aspect of the presently disclosed subject matter, a vehicle lighting unit can include: a reflector having, as a front surface thereof, a concave reflecting surface formed on the basis of a revolved parabolic surface with respect to an optical axis extending in a front-to-rear direction of a vehicle body and serving as a rotational symmetric axis, the reflecting surface configured to have a focal point disposed on or near the optical axis; a reflecting plate disposed along the optical axis in front of the reflecting surface and having a front edge and a rear edge so as to divide a space in front of the reflecting surface into two regions including a first region and a second region, one of the front edge and the rear edge being disposed at or near the focal point; a first light emitting element disposed in the first region of the two regions and in front of the focal point, the first light emitting element being directed to the focal point; and a first condenser lens disposed between the first light emitting element and the focal point, the first condenser lens configured to collect light emitted from the first light emitting element to a position at or near the focal point. In this vehicle lighting unit, the range within which the reflecting surface is formed can be from the first region to the second region with respect to the optical axis when viewed from its front side, and a part of the light collected by the first condenser lens can be reflected by the reflecting plate near the front edge or the rear edge, can be directed to a first portion of the reflecting surface in the first region so as to be reflected forward by the first portion of the reflecting surface in the first region, and another part of the light collected by the first condenser lens can pass before the front edge or behind the rear edge and can travel to a second portion of the reflecting surface in the second region to be reflected forward by the second portion of the reflecting surface in the second region.

The vehicle lighting unit with the above configuration can preferably further include a decoration plate disposed along the optical axis in front of the reflecting plate, the decoration plate configured to divide the space in front of the reflecting surface together with the reflecting plate into the two regions.

The vehicle lighting unit with the above configuration can preferably further include: a second light emitting element disposed in the second region and in front of the focal point, the second light emitting element directed to the focal point; and a second condenser lens disposed between the second light emitting element and the focal point, the second condenser lens configured to collect light emitted from the second light emitting element to a position at or near the focal point. In this vehicle lighting unit, a part of the light collected by the second condenser lens can be reflected by the reflecting plate near the front edge or the rear edge, can be directed to the second portion of the reflecting surface in the second region so as to be reflected forward by the second portion of the reflecting surface in the second region, and another part of the light collected by the second condenser lens can pass before the front edge or behind the rear edge and can travel to the first portion of the reflecting surface in the second region to be reflected forward by the second portion of the reflecting surface in the second region.

In embodiments made in accordance with principles of the presently disclosed subject matter, the light emitting element(s) is not disposed at the focal point of the reflecting surface of the reflector, but can be disposed in any one of the divided regions of the space in front of the reflecting surface, divided by the reflecting plate. Accordingly, the front or rear edge of the reflecting plate can be disposed at or near the focal point of the reflecting surface. With this configuration, since the light emitting element can be disposed to be directed toward the focal point and the condenser lens can collect light emitted by the light emitting element to a position at or near the focal point of the reflecting surface, the light can be separated into light to be reflected by the reflecting plate and light to pass before the front edge of the reflecting plate or behind the rear edge of the reflecting plate. Furthermore, since the area within which the reflecting surface is formed can range between both the regions divided by the reflecting plate from the optical axis, the light reflected by the reflecting plate can be reflected forward by the first portion of the reflecting plate in the first region while another part of light passing before the front edge or behind the rear edge can be reflected forward by the second portion of the reflecting surface in the second region. Therefore, the reflecting surface from the first region to the second region can be effectively utilized.

Furthermore, since the space in front of the reflecting surface can be divided into two regions by the reflecting plate and the light divided by the traveling paths can be reflected by the first portion and the second portion of the reflecting surface in the first and second regions, respectively, the vehicle lighting unit can have an original appearance that has not been present, yet. Furthermore, the vehicle lighting unit with the above configuration can be observed as if it has two light sources. This can enhance the aesthetic effects as a lighting unit.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lighting units of the presently disclosed subject matter with reference to the accompanying drawings in accordance with exemplary embodiments. It should be noted that the following exemplary embodiments may include various technical limitations for embodying the presently disclosed subject matter, but the scope of the presently disclosed subject matter cannot be limited to the exemplary embodiments and illustrated examples.

Further, it should be noted that front (forward), rear (back, rearward), right, left, upper (up, upward), and lower (downward) directions used herein can be words of convenience based on those of the vehicle lighting unit when normally mounted on a vehicle body, unless otherwise specified.

First Exemplary Embodiment

Figure 1:
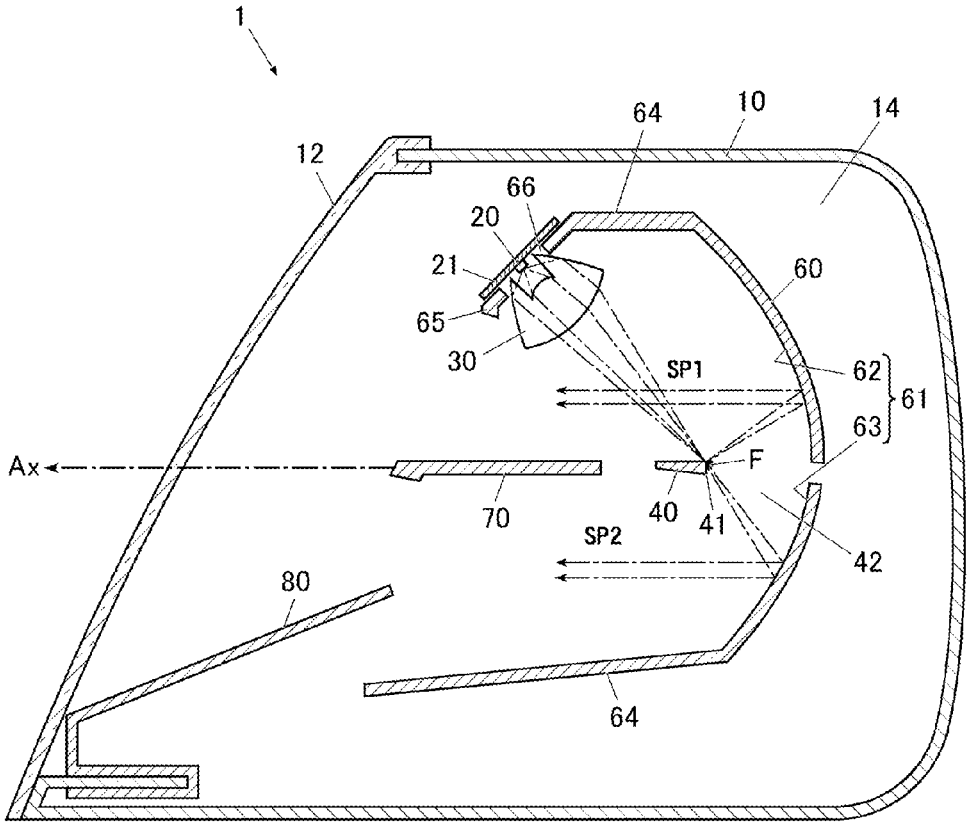
FIG. 1 is a longitudinal cross-sectional view illustrating a vehicle lighting unit according to a first exemplary embodiment made in accordance with principles of the presently disclosed subject matter.
Figure 2:
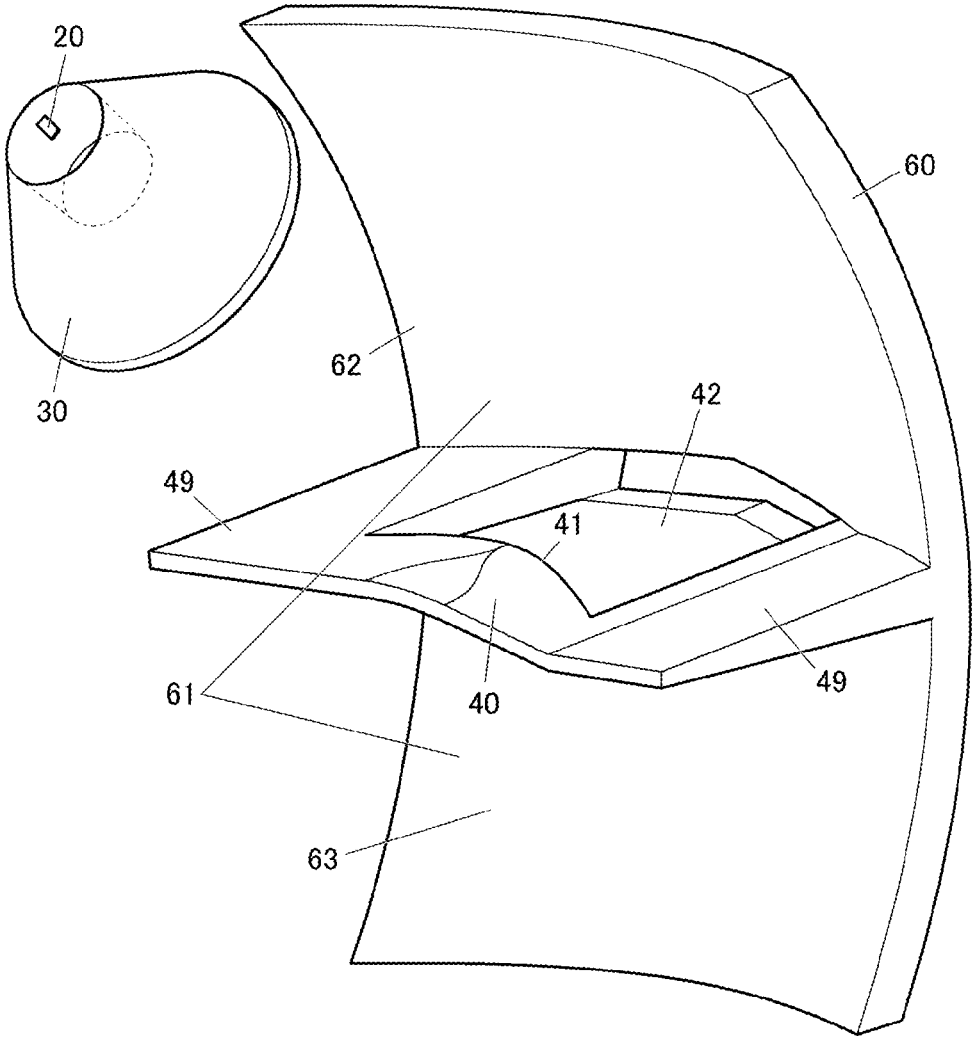
FIG. 2 is a perspective view illustrating essential parts of the vehicle lighting unit of FIG. 1.
Figure 3:
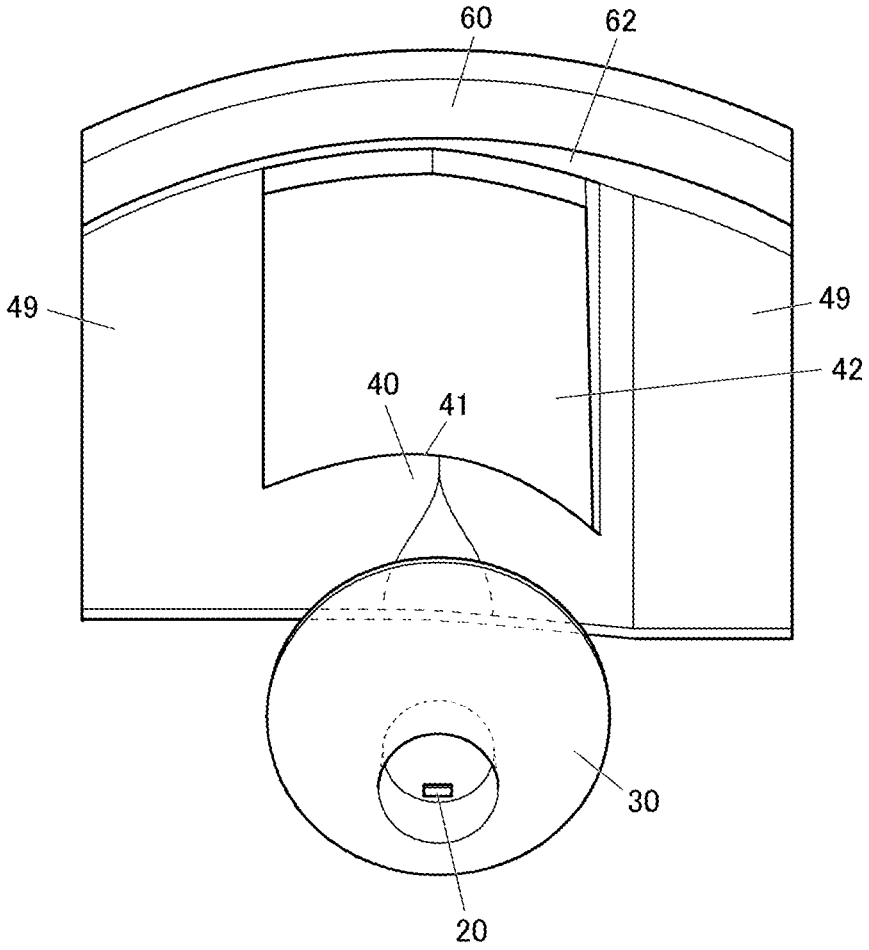
FIG. 3 is a plan view illustrating the essential parts of the vehicle lighting unit of FIG. 1.
Figure 4:
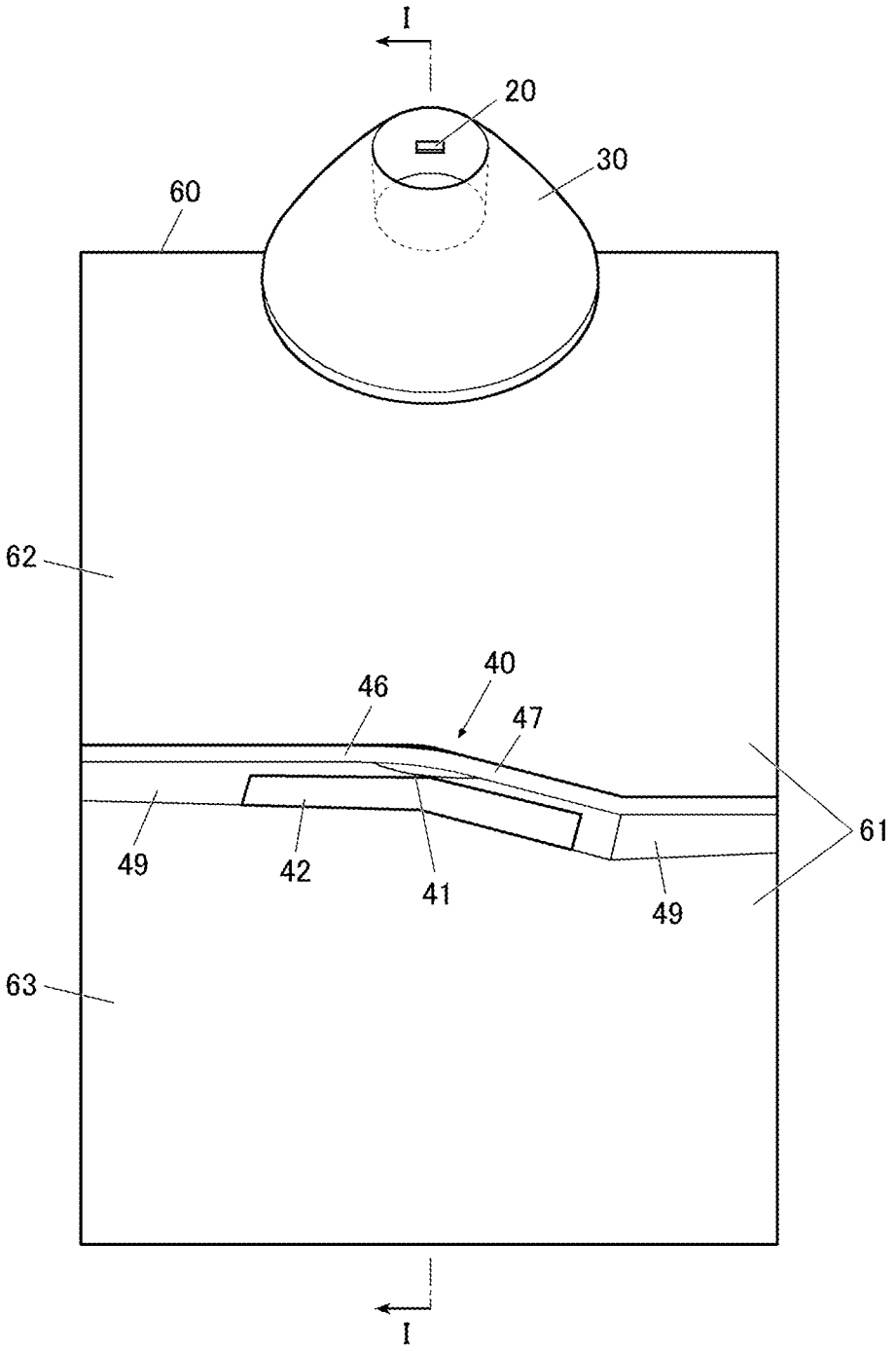
FIG. 4 is a front view illustrating the essential parts of the vehicle lighting unit of FIG. 1.

FIG. 1 is a longitudinal cross-sectional view illustrating a vehicle lighting unit 1 according to a first exemplary embodiment made in accordance with principles of the presently disclosed subject matter. The vehicle lighting unit has its optical axis Ax in a front-to-rear direction of a vehicle body on which the vehicle lighting unit is assumed to be normally installed, and the cross section illustrated in FIG. 1 is assumed to pass the optical axis Ax of the vehicle lighting unit 1 and is orthogonal to the horizontal plane (vertically taken along the optical axis Ax). FIGS. 2, 3, and 4 are a perspective view, a plan view, and a front view each illustrating essential parts of the vehicle lighting unit 1, respectively.

In this exemplary embodiment, the vehicle lighting unit 1 can be used for a low-beam headlight.

The vehicle lighting unit 1 can include a housing 10, an outer lens 12, a light emitting element 20, a condenser lens 20, a reflecting plate 40, a reflector 60, a decoration plate 70, and an extension 80, for example.

The housing 10 can be formed in a box shape having a space thereinside and an opening at its front side. The outer lens 12 serving as a transparent cover can be attached to the front edge of the opening of the housing 10 so as to close the front opening of the housing 10. The housing 10 and the outer lens 12 can define a lighting chamber 14.

The lighting chamber 14 can accommodate the light emitting element 20, the condenser lens 30, the reflecting plate 40, the reflector 60, the decoration plate 70, and the extension 80. They can be directly or indirectly secured to the housing 10 by any means like screwing, adhering, or integrally molding.

The reflector 60 can be a parabolic reflector. The reflector 60 can include a concave shape having a reflecting surface 61 at its front side, and the reflecting surface 61 can be formed on the basis of the paraboloid of revolution. The rotational symmetric axis of the paraboloid of revolution can extend forward from the center of the reflecting surface 61 (apex of the reflecting surface 61) and can coincide with the optical axis Ax of the vehicle lighting unit 1. A reflecting film, such as a metal film by vapor deposition, sputtering, or other vapor-phase growth methods, can be deposited on the reflecting surface 61. The parabolic reflecting surface 61 can have a focal point F, or the focal point F of the paraboloid of revolution on the basis of which the reflecting surface 61 can be formed. The focal point F can be set on the optical axis Ax of the reflecting surface 61.

The reflecting surface 61 can be formed in a range above and below a horizontal plane including the optical axis Ax. Accordingly, the reflecting surface 61 can be composed of an upper reflecting surface 62 (a first portion) above the horizontal plane including the optical axis Ax and a lower reflecting surface 63 (a second portion) below the horizontal plane.

Further, the reflector 60 can be a multi-reflector. Specifically, the upper reflecting surface 62 and the lower reflecting surface 63 can be divided into a plurality of regions, which are each formed into a small reflecting surface with a parabolic columnar surface, a free curved surface, etc. Such small reflecting surfaces can be aligned along the paraboloid of revolution to form the reflecting surface 61 based on the paraboloid of revolution. Thus, the collective entity of these small reflecting surfaces can constitute the reflecting surface 61.

A frame 64 can be provided to the reflector 60 at its rim so as to extend forward from the rim of the reflector 60.

The extension 80 can be disposed in front of the lower portion of the frame 64, meaning that the lower portion of the frame 64 can be hindered by the extension 80 when viewed from its front side.

A plate-like fixing portion 65 can be provided to the front end of the upper portion of the frame 64. Specifically, the fixing portion 65 can be inclined and hung from the front end of the upper portion of the frame 64. Furthermore, an opening 66 can be formed in the fixing portion 65 for allowing the light emitting element 20 to be inserted thereinto.

A substrate 21 can be attached to the front-side surface of the fixing portion 65 as shown in FIG. 1, so that the substrate 21 can be inclined forward and downward with respect to the horizontal plane. The light emitting element 20 can be mounted on the substrate 21 so as to be located inside the opening 66 of the fixing portion 65. Accordingly, the light emitting element 20 can be disposed to be displaced from the optical axis Ax of the reflecting surface 61 upwardly. Furthermore, the light emitting element 20 can be disposed forward more than a vertical plane including the focal point F of the reflecting surface 61 and being orthogonal to the optical axis Ax. The light emitting element 20 can be disposed below the upper portion of the frame 64 so as to be located inside the frame 64 when viewed from its front side. A vertical plane passing through the optical axis Ax of the reflecting surface 61 can pass the light emitting element 20. Furthermore, the light emitting element 20 can be directed to the focal point F of the reflecting surface 61, i.e., so as to be disposed in front of the focal point F. Then, the light emitting element 20 can have an optical axis extending from the light emitting element 20 rearward and obliquely downward and located within the vertical plane passing through the optical axis Ax of the reflecting surface 61.

The condenser lens 30 can be attached to the rear surface of the fixing portion 65 so that the condenser lens 30 can face the light emitting element 20 through the opening 66 of the fixing portion 65. Accordingly, the condenser lens 30 can be disposed to be displaced from the optical axis Ax of the reflecting surface 61 upwardly. Furthermore, the condenser lens 30 can be disposed between the light emitting element 20 and the focal point F of the reflecting surface 61.

The condenser lens 30 can have an optical axis passing through the light emitting element 20. Thus, the condenser lens 30 can have the optical axis extending from the light emitting element 20 rearward and obliquely downward and located within the vertical plane passing through the optical axis Ax of the reflecting surface 61. In the present exemplary embodiment, it is preferable that the optical axis of the condenser lens 30 coincide with that of the light emitting element 20.

The optical axis of the condenser lens 30 and that of the reflecting surface 61 can intersect with each other at or near the focal point F of the reflecting surface 61. The thus configured condenser lens 30 can collect light emitted from the light emitting element 20 to form a light spot at or near the focal point F of the reflecting surface 61.

The reflecting plate 40 can be disposed in front of the reflector 60. The reflecting plate 40 can be aligned along the optical axis Ax so as to divide the space in front of the reflecting surface 61. Specifically, the space in front of the reflecting surface 61 can be divided by the reflecting plate 40 into an upper region (SP1) above the reflecting plate 40 (a first region SP1 where the light emitting element 20 and the condenser lens 30 are located) and a lower region (SP2) below the reflecting plate 40 (a second region SP2 opposite to the first region SP 1 with respect to the reflecting plate 40).

The reflecting plate 40 can include connecting portions 49 on the left and right sides of the reflecting plate 40. The connecting portions 49 extending rearward from the left and right sides of the reflecting plate 40 can connect the left and right sides of the reflecting plate 40 with the reflector 60 at both left and right sides of the reflector 60 on the boundary between the upper reflecting surface 62 and the lower reflecting surface 63. This can integrally form the reflector 60, the reflecting plate 40, and the connecting portions 49 as illustrated in FIG. 2. A reflecting film, such as a metal film by vapor deposition, sputtering, or other vapor-phase growth methods, can be deposited on the surfaces of the reflecting plate 40 and the connecting portions 49. This can configure the upper surface and the lower surface of the reflecting plate 40 functioning as a reflecting surface.

The reflecting plate 40 can have a rear edge 41 located in front of and apart from the reflecting surface 61. Accordingly, on the rear side of the rear edge 41 of the reflecting plate 40, formed is an opening 42 defined by the reflecting plate 40, the reflector 60, and the connecting portions 49.

The rear edge 41 of the reflecting plate 40 can be formed in a concave arc shape when viewed from its upper or lower side. The central portion of the rear edge 41 of the reflecting plate 40 can be disposed at or near the focal point F of the reflecting surface 61. Accordingly, the condenser lens 30 can collect light emitted from the light emitting element 20 to a position at or near the central portion of the rear edge 41 of the reflecting plate 40.

Examples of the concrete shape of the reflecting plate 40 may include the following (1) to (3):

(1) As illustrated in FIG. 4, the portion 46 of the reflecting plate 40 on the own vehicle traveling lane side with respect to the optical axis Ax is provided horizontally whereas the portion 47 of the reflecting plate 40 on the opposite lane side with respect to the optical axis Ax is configured to be inclined downward from the own vehicle traveling lane side toward the opposite lane side. The rear edge 41 of the reflecting plate 40 when viewed from front or rear side can follow the shape of the horizontal portion 46 and the inclined portion 47. This shape (1) corresponds to the shape of the reflecting plate 40 illustrated in FIGS. 1 to 4.

Figure 5:
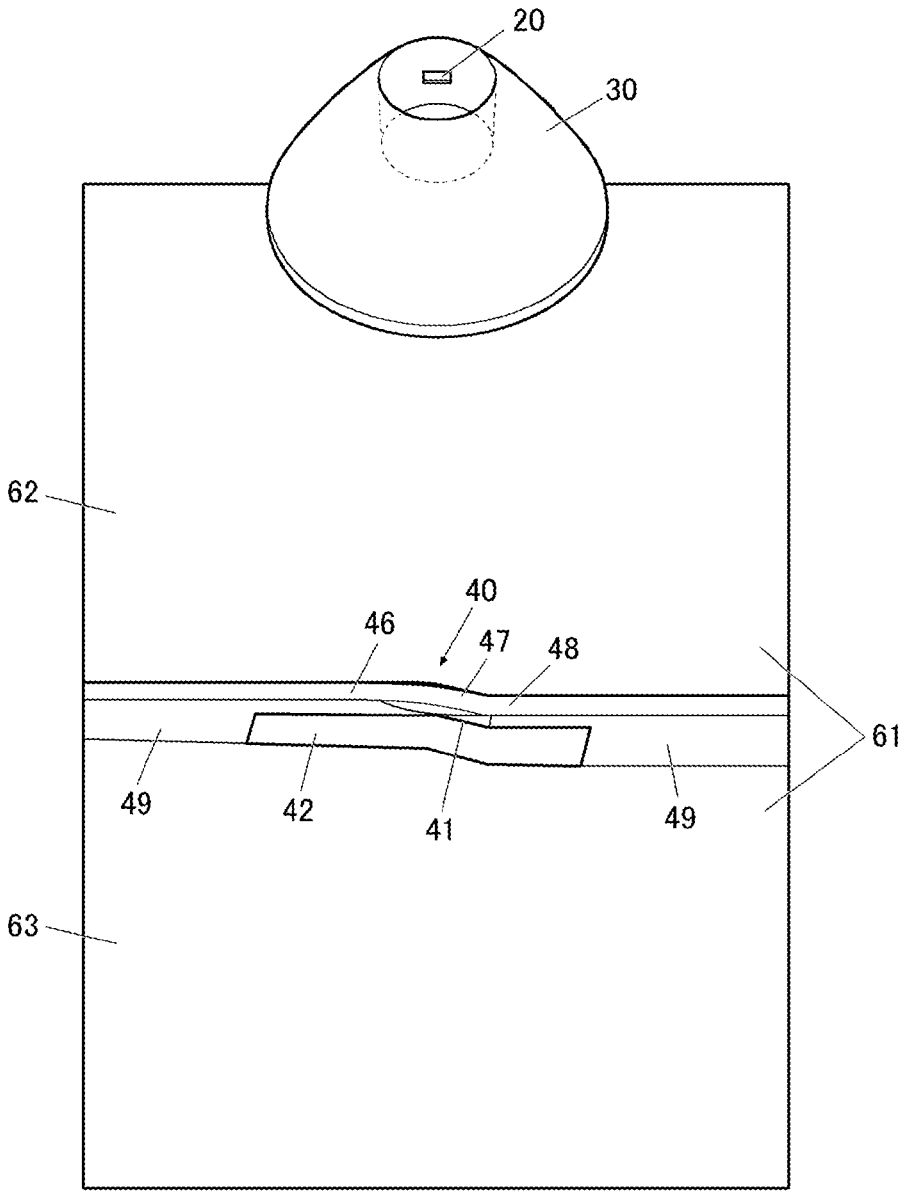
FIG. 5 is a front view illustrating the essential parts of the vehicle lighting unit of FIG. 1, which are modified in part.

(2) As illustrated in FIG. 5, the portion 46 of the reflecting plate 40 on the own vehicle traveling lane side with respect to the optical axis Ax is provided horizontally whereas the portion 47 of the reflecting plate 40 on the opposite lane side with respect to the optical axis Ax is configured to be inclined. In addition, the portion 48 of the reflecting plate 40 continued from the portion 47 on the opposite lane side is made horizontal. The portion 47 is inclined downward from the own vehicle traveling lane side toward the opposite lane side. Both the horizontal portions 46 and 48 are arranged to be staggered via the portion 47. The rear edge 41 of the reflecting plate 40 when viewed from front or rear side can follow the shape of the horizontal portions 46 and 48 and the inclined portion 47.

(3) The reflecting plate 40 in the entire width is provided horizontally, meaning that the right and left portions of the reflecting plate 40 with respect to the optical axis Ax are not staggered. The rear edge 41 of the reflecting plate 40 when viewed from front or rear side can follow the shape of the horizontal reflecting plate 40.

The respective shapes of the reflecting plates 40 illustrated in FIGS. 4 and 5 are for use in right-hand traffic. Thus, if the vehicle lighting unit 1 is applied to left-hand traffic vehicles, the respective shapes of the reflecting plates 40 illustrated in FIGS. 4 and 5 are reversed horizontally.

In front of the reflecting plate 40, the decoration plate 70 can be disposed along the optical axis Ax. Accordingly, the space in front of the reflecting surface 61 can be divided also by the decoration plate 70 into the upper region (SP1) above the decoration plate 70 (the first region SP1 where the light emitting element 20 and the condenser lens 30 are located) and the lower region (SP2) below the decoration plate 70 (the second region SP2 opposite to the first region SP1 with respect to the decoration plate 70). Herein, the decoration plate 70 can include connection portions (not illustrated) on the left and right sides of the decoration plate 70 so as to be connected to the extension 80 as an integrally molded product.

As illustrated in FIG. 1, the decoration plate 70 can be apart from the reflecting plate 40 in the forward direction. Note that the decoration plate 70 may be connected to the reflecting plate 40 to be an integrally molded product.

Next, a description will be given of how the light emitted from the light emitting element 20 can travel.

The light emitted from the light emitting element 20 can be collected by the condenser lens 30 to, or in the vicinity of, the central portion of the rear edge 41 of the reflecting plate 40. Part of the collected light can be reflected by the upper surface of the reflecting plate 40 near the rear edge 41 of the reflecting plate 40 to the upper reflecting surface 62 of the reflector 60 in the first region SP 1. Another part of the collected light can pass through the rear side of the rear edge 41 of the reflecting plate 40 downward, namely, through the opening 42, to travel to the lower reflecting surface 63 of the reflector 60 in the second region SP2.

The light reflected by the upper surface of the reflecting plate 40 can be incident on the upper reflecting surface 62 and be reflected forward by the same. Then, the reflected light can travel forward above the reflecting plate 40 and the decoration plate 70.

The light emitted from the light emitting element 20 and collected by the condenser lens 30 can be reflected by the upper surface of the reflecting plate 40 at or near the focal point F of the reflecting surface 61 (the focal point F of the reflecting surface 61 can be set to the position where the rear edge 41 of the reflecting plate 40 is located) and can be then reflected by the upper reflecting surface 62. Accordingly, the light reflected by the upper reflecting surface 62 can be projected to an area below a horizontal plane passing through the optical axis Ax. Thus, on a virtual screen assumed to be formed in front of the vehicle lighting unit 1 (see FIGS. 6 to 8), a bright area can be formed below the H line (horizontal line). As illustrated in the drawings, a bright-dark boundary line (or cut-off line) is formed at the upper edge of the bright area (between the bright area and dark area positioned upper than the bright area). It should be noted that the shape of the bright-dark boundary line can be the shape obtained by vertically and horizontally reversing the shape of the rear edge 41 of the reflecting plate 40 when the reflecting plate 40 is observed from the rear side.

Figure 6:
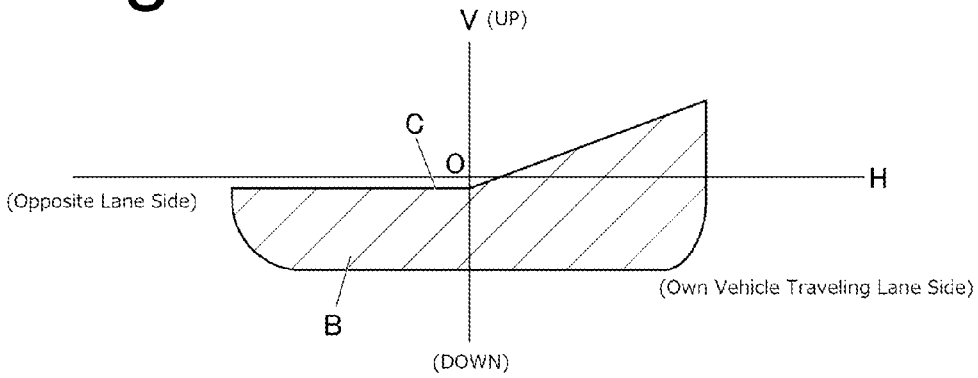
FIG. 6 is an explanatory view illustrating one example of a bright-dark boundary line formed on a virtual screen assumed to be formed in front of the vehicle lighting unit.
Figure 7:
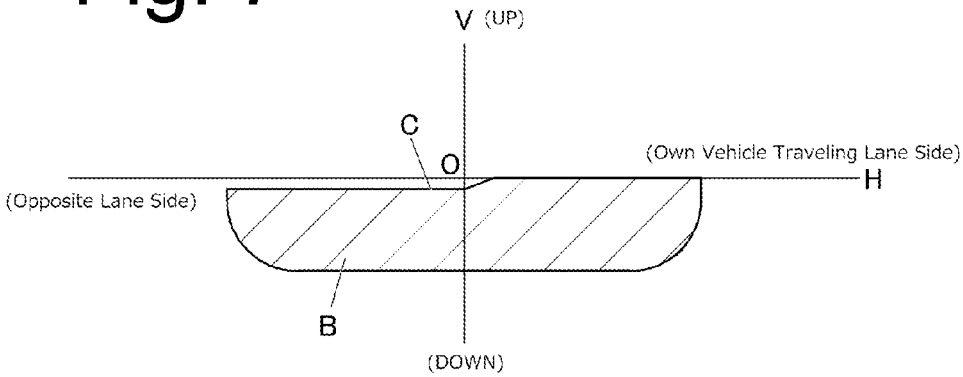
FIG. 7 is an explanatory view illustrating another example of a bright-dark boundary line formed on a virtual screen assumed to be formed in front of the vehicle lighting unit.
Figure 8:
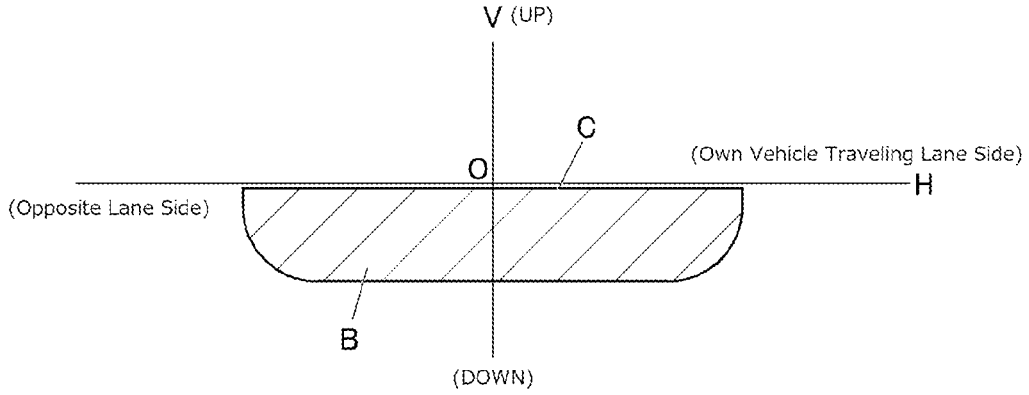
FIG. 8 is an explanatory view illustrating still another example of a bright-dark boundary line formed on a virtual screen assumed to be formed in front of the vehicle lighting unit.

Herein, note that the virtual screen means a projection screen virtually obtained in front of the vehicle lighting unit, and the optical axis Ax is orthogonal to the virtual screen. The point of origin O shown in FIGS. 6 to 8 represents an intersection of the optical axis Ax and the virtual screen, the H line represents a line of intersection of the virtual screen and the horizontal plane passing through the optical axis Ax, and the V line represents a line of intersection of the virtual screen and the vertical plane passing through the optical axis Ax.

The light passing through the rear side of the rear edge 41 of the reflecting plate 40 (behind the rear edge 41) can be reflected forward by the lower reflecting surface 63. Then, the reflected light can travel forward below the reflecting plate 40 and the decoration plate 70.

The light emitted from the light emitting element 20 and collected by the condenser lens 30 can pass through the rear side of the rear edge 41 of the reflecting plate 40 at or near the focal point F of the reflecting surface 61 (the focal point F of the reflecting surface 61 can be set to the position where the rear edge 41 of the reflecting plate 40 is located) and can be then reflected by the lower reflecting surface 63. Accordingly, the light reflected by the lower reflecting surface 63 can be projected to the area below the horizontal plane passing through the optical axis Ax. Thus, on the virtual screen in front of the vehicle lighting unit 1 (see FIGS. 6 to 8), a bright area can be formed below the H line. A bright-dark boundary line is formed at the upper edge of the bright area. Also in this case, the shape of the bright-dark boundary line can be the shape obtained by vertically and horizontally reversing the shape of the rear edge of the reflecting plate 40 when the reflecting plate 40 is observed from the rear side.

In this manner, the bright areas formed by the light reflected by the upper and lower reflecting surfaces 62 and 63 can be synthesized on the virtual screen, so that the clear bright-dark boundary line can be formed at the upper edge of the synthesized bright area. As a result, the shape of the bright-dark boundary line at the upper edge of the synthesized bright area can be the clear shape obtained by vertically and horizontally reversing the shape of the rear edge of the reflecting plate 40 when the reflecting plate 40 is observed from the rear side.

FIG. 6 is an explanatory view illustrating the example of the bright area B and the bright-dark boundary line C formed on the virtual screen when the concrete shape of the reflecting plate 40 takes the above shape (1). The shape of the rear edge 41 of the horizontal portion 46 illustrated in FIG. 4 is projected on the opposite lane side to form the horizontal bright-dark boundary line C just below the H line as illustrated in FIG. 6. In addition to this, the shape of the rear edge 41 of the inclined portion 47 illustrated in FIG. 4 is projected on the own vehicle traveling lane side to form the bright-dark boundary line C inclined with respect to the H line as illustrated in FIG. 6. Accordingly, the vehicle lighting unit 1 can form the synthesized bright-dark boundary line C as a whole as illustrated in FIG. 6.

FIG. 7 is an explanatory view illustrating the example of the bright area B and the bright-dark boundary line C formed on the virtual screen when the concrete shape of the reflecting plate 40 takes the above shape (2). The shape of the rear edge 41 of the horizontal portion 46 on the own vehicle traveling lane side illustrated in FIG. 5 is projected on the opposite lane side to form the horizontal bright-dark boundary line C just below the H line as illustrated in FIG. 7. In addition to this, the shape of the rear edge 41 of the inclined portion 47 on the opposite lane side illustrated in FIG. 5 is projected on the own vehicle traveling lane side to form the bright-dark boundary line C inclined with respect to the H line as illustrated in FIG. 7. Furthermore, the shape of the rear edge 41 of the horizontal portion 48 on the opposite lane side illustrated in FIG. 5 is projected on the own vehicle traveling lane side to form the bright-dark boundary line C along the H line as illustrated in FIG. 7. Accordingly, the vehicle lighting unit 1 can form the synthesized bright-dark boundary line C as a whole as illustrated in FIG. 7.

FIG. 8 is an explanatory view illustrating the example of the bright area B and the bright-dark boundary line C formed on the virtual screen when the concrete shape of the reflecting plate 40 takes the above shape (3). The shape of the entirely horizontal rear edge 41 of the reflecting plate 40 is projected to the virtual screen to form the horizontal bright-dark boundary line C just below or along the H line as illustrated in FIG. 8.

With this vehicle lighting unit 1 alone or in combination with other lighting units, the light distribution of the bright area B illustrated in any of FIGS. 6 to 8 can satisfy various light distribution standards for low-beam headlamps.

The above-described exemplary embodiment can exert the following advantageous effects.

(1) In the present exemplary embodiment, the light emitting element 20 is not disposed at the focal point F of the reflecting surface 61, but the light emitted from the light emitting element 20 can be collected by the condenser lens 30 to form a spot light at the rear edge 41 of the reflecting plate 40. This configuration can divide the light to passing light directed to the lower reflecting surface 63 and reflected light directed to the upper reflecting surface 62. Therefore, even when a light emitting element (20) is used which does not emit light in all directions, the reflecting surface 61 can be effectively utilized from the region upper than the focal point F thereof (upper reflecting surface 62) to the region lower than the focal point F thereof (lower reflecting surface 63).

(2) Even when a single light emitting element (20) is used, the vehicle lighting unit can provide a novel appearance as if it includes two light sources. In other words, the vehicle lighting unit 1 can be observed as if it is composed of a lighting unit utilizing an upper reflecting surface (62) and another lighting unit utilizing a lower reflecting surface (63). In particular, as the reflecting plate 40 and the decoration plate 70 are utilized to divide the space in front of the reflecting surface 61 into upper and lower regions SP1 and SP2, the two-lamp system appearance of the vehicle lighting unit 1 can be emphasized.

(3) The reflecting surface 61 can be formed on the basis of the paraboloid of revolution, and the light can be collected by the condenser lens 30 to a position at or near the focal point F of the reflecting surface 61. Thus, the light further reflected by the reflecting surface 61 can be substantially collimated when viewed from its lateral direction. With this configuration, the light having been reflected by the reflecting surface 61 can travel forward without hindrance by the decoration plate 70 and the reflecting plate 40. This can improve the effective utilization of light. Furthermore, as almost all the light reflected by the upper reflecting surface 62 and the light reflected by the lower reflecting surface 63 do not intersect one another, the two-lamp system appearance of the vehicle lighting unit 1 can be implemented.

Second Exemplary Embodiment

Figure 9:
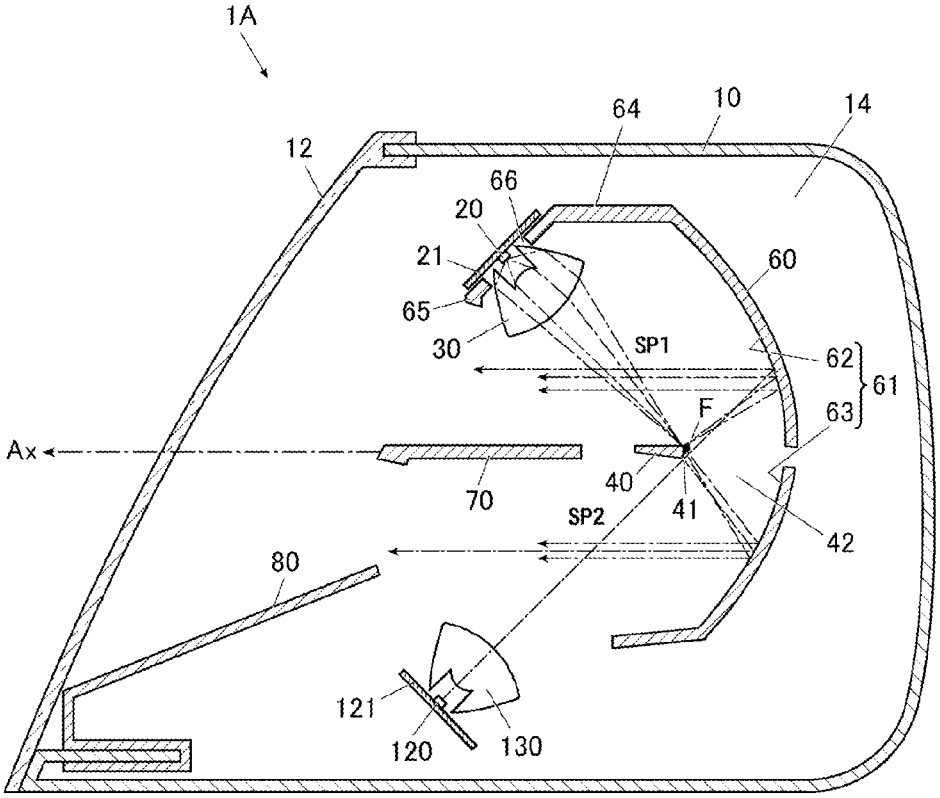
FIG. 9 is a longitudinal cross-sectional view illustrating a vehicle lighting unit according to a second exemplary embodiment made in accordance with the principles of the presently disclosed subject matter.

FIG. 9 is a longitudinal cross-sectional view illustrating a vehicle lighting unit 1A according to a second exemplary embodiment made in accordance with the principles of the presently disclosed subject matter.

In the second exemplary embodiment, the same or similar components of the vehicle lighting unit 1A as or to those of the vehicle lighting unit 1 of the first exemplary embodiment may be denoted by the same or similar reference numerals, and descriptions thereof will be omitted appropriately. Hereinafter, different points between the vehicle lighting unit 1 of the first exemplary embodiment and the vehicle lighting unit 1A of the second exemplary embodiment will be mainly described.

The vehicle lighting unit 1A can be applied to a vehicle headlamp capable of switching over between low beam emission and high beam emission. The vehicle lighting unit 1A can include, in addition to the configuration of the vehicle lighting unit 1 of the first exemplary embodiment, a light emitting element 120, a substrate 121, and a condenser lens 130.

The light emitting element 120 can be mounted on the substrate 121. The light emitting element 120 can be disposed to be displaced from the optical axis Ax of the reflecting surface 61 downwardly. Furthermore, the light emitting element 120 can be disposed forward more than a vertical plane including the focal point F of the reflecting surface 61 and being orthogonal to the optical axis Ax. A vertical plane passing through the optical axis Ax of the reflecting surface 61 can pass the light emitting element 120. Furthermore, the light emitting element 120 can be directed to the focal point F of the reflecting surface 61, and thus, be positioned in front of the focal point F. Then, the light emitting element 120 can have an optical axis extending from the light emitting element 120 rearward and obliquely upward and located within the vertical plane passing through the optical axis Ax of the reflecting surface 61.

The condenser lens 130 can be disposed to be displaced from the optical axis Ax of the reflecting surface 61 downwardly. Furthermore, the condenser lens 130 can be disposed between the light emitting element 120 and the focal point F of the reflecting surface 61. The condenser lens 130 can have an optical axis passing through the light emitting element 120. Then, the condenser lens 130 can have the optical axis extending from the light emitting element 120 rearward and obliquely upward and located within the vertical plane passing through the optical axis Ax of the reflecting surface 61. In the present exemplary embodiment, it is preferable that the optical axis of the condenser lens 130 coincide with that of the light emitting element 120.

The optical axis of the condenser lens 130 and that of the reflecting surface 61 can intersect with each other at or near the focal point F of the reflecting surface 61. The thus configured condenser lens 130 can collect light emitted from the light emitting element 120 to form a light spot at or near the focal point F of the reflecting surface 61.

In the vehicle lighting unit 1A with this configuration, when a low beam (passing-by beam) is to be produced, the light emitting element 20 is turned on while the light emitting element 120 is turned off. Accordingly, the bright area B as illustrated in any of FIGS. 6 to 8 can be formed on the virtual screen with the same light distribution of the bright area B as in the first exemplary embodiment.

On the other hand, when a high beam (travelling beam) is to be produced, both the light emitting elements 20 and 120 are turned on. The light emitted from the light emitting element 120 can be collected by the condenser lens 130 to, or in the vicinity of, the central portion of the rear edge 41 of the reflecting plate 40. Part of the collected light can be reflected by the lower surface of the reflecting plate 40 near the rear edge 41 of the reflecting plate 40 to the lower reflecting surface 63 of the reflector 60 in the second region SP2. Another part of the collected light can pass through the rear side of the rear edge 41 of the reflecting plate 40 upward, namely, through the opening 42, to travel to the upper reflecting surface 62 in the first region SP 1.

The light reflected by the lower surface of the reflecting plate 40 can be incident on the lower reflecting surface 63 and be reflected forward by the same. Then, the reflected light can travel forward below the reflecting plate 40 and the decoration plate 70. The light reflected by the lower reflecting surface 63 can be projected to an area above the H line in the virtual screen or spread vertically and horizontally around the point of origin O.

The light passing through the rear side of the rear edge 41 of the reflecting plate 40 can be reflected by the upper reflecting surface 62 forward. Then, the reflected light can travel forward above the reflecting plate 40 and the decoration plate 70. The light reflected by the upper reflecting surface 62 can be projected to an area above the H line in the virtual screen or spread vertically and horizontally around the point of origin O.

With this vehicle lighting unit 1A alone or in combination with other lighting units, the light distribution of the bright area formed by the light emitting elements 20 and 120 being turned on simultaneously can satisfy various light distribution standards for high-beam headlamps.

The same or similar advantageous effects as or to those in the first exemplary embodiment can be obtained also in the second exemplary embodiment. In addition to these effects, the second exemplary embodiment can switch over between a high beam and a low beam.

Third Exemplary Embodiment

Figure 10:
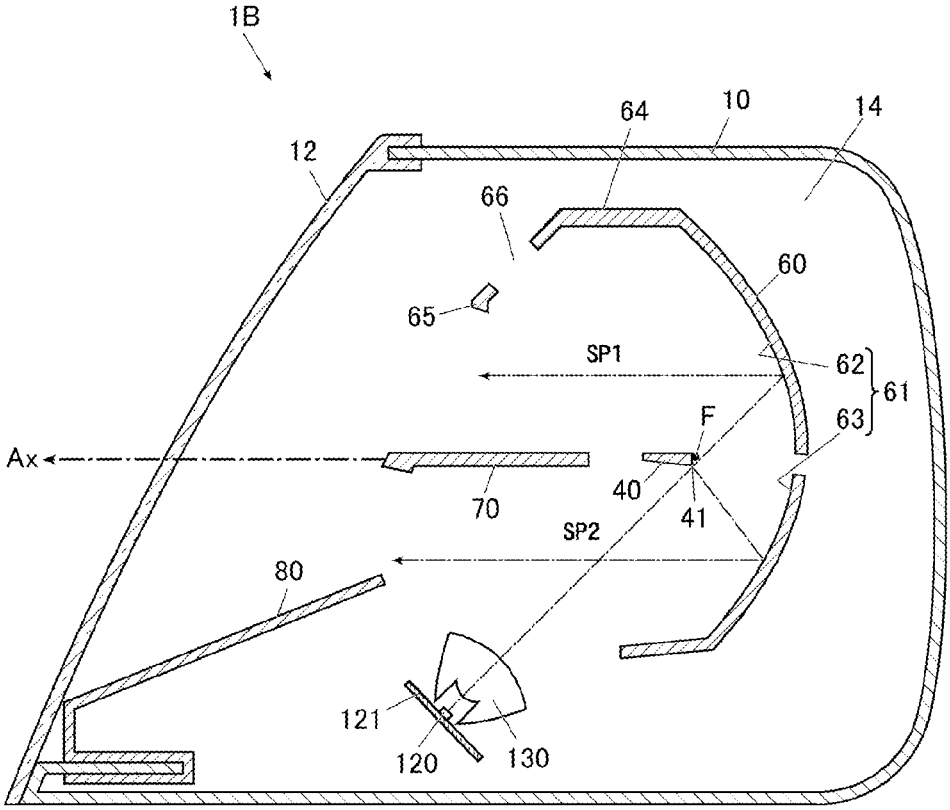
FIG. 10 is a longitudinal cross-sectional view illustrating a vehicle lighting unit according to a third exemplary embodiment made in accordance with the principles of the presently disclosed subject matter.

FIG. 10 is a longitudinal cross-sectional view illustrating a vehicle lighting unit 1B according to a third exemplary embodiment made in accordance with the principles of the presently disclosed subject matter.

In the third exemplary embodiment, the same or similar components of the vehicle lighting unit 1B as or to those of the vehicle lighting unit 1A of the second exemplary embodiment may be denoted by the same or similar reference numerals, and descriptions thereof will be omitted appropriately. Hereinafter, different points between the vehicle lighting unit 1A of the second exemplary embodiment and the vehicle lighting unit 1B of the third exemplary embodiment will be mainly described.

The vehicle lighting unit 1B can be applied to a vehicle headlamp capable of generating high beam. Specifically, the vehicle lighting unit 1B does not include the light emitting element 20, the substrate 21, and the condenser lens 30, which have been provided to the vehicle lighting unit 1A of the second exemplary embodiment.

With this vehicle lighting unit 1B alone or in combination with other lighting units, the light distribution of the bright area formed by the light emitting element 120 being turned on can satisfy various light distribution standards for high-beam headlamps.

Note that the decoration plate 70, the reflecting plate 40, the light emitting element 120, the substrate 121, and the condenser lens 130 may be arranged at respective positions derived by rotating the decoration plate 70, the reflecting plate 40, the light emitting element 120, the substrate 121, and the condenser lens 130 (illustrated in FIG. 10) by 90 degrees.

Fourth Exemplary Embodiment

Figure 11:
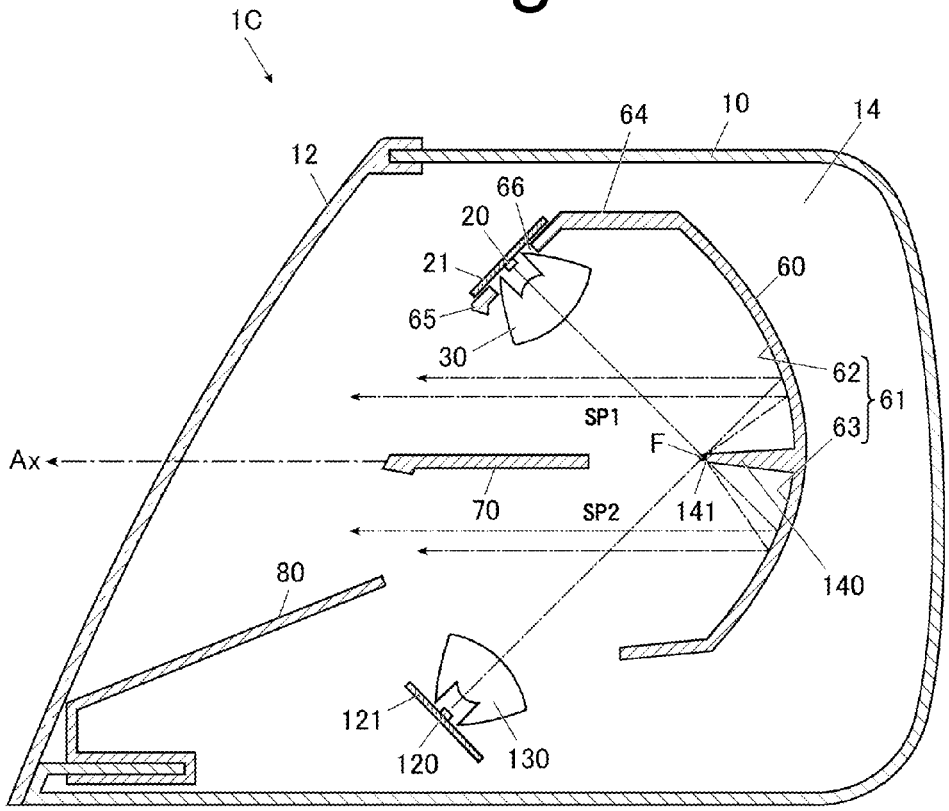
FIG. 11 is a longitudinal cross-sectional view illustrating a vehicle lighting unit according to a fourth exemplary embodiment made in accordance with the principles of the presently disclosed subject matter.

FIG. 11 is a longitudinal cross-sectional view illustrating a vehicle lighting unit 1C according to a fourth exemplary embodiment made in accordance with the principles of the presently disclosed subject matter.

In the fourth exemplary embodiment, the same or similar components of the vehicle lighting unit 1C as or to those of the vehicle lighting unit 1A of the second exemplary embodiment may be denoted by the same or similar reference numerals, and descriptions thereof will be omitted appropriately. Hereinafter, different points between the vehicle lighting unit 1A of the second exemplary embodiment and the vehicle lighting unit 1C of the fourth exemplary embodiment will be mainly described.

The vehicle lighting unit 1C can include a reflecting plate 140 in place of the reflecting plate 40 of the vehicle lighting unit 1A of the second exemplary embodiment.

The reflecting plate 140 can extend forward along the optical axis Ax from the boundary between the upper reflecting surface 62 and the lower reflecting plate 63 of the reflecting surface 61. Also in this case, the space in front of the reflecting surface 61 can be divided into the upper region SP1 and the lower region SP2 by the reflecting plate 140. The reflecting plate 140 can have a front edge 141, which can be separated away from the rear end of the decoration plate 70 rearward. Then, the reflecting surface 61 can have a focal point F at or near the central portion of the front edge 141 of the reflecting plate 140.

The vehicle lighting unit 1C can be applied to a vehicle headlamp capable of switching over between a low beam and a high beam. When generating a low beam, the light emitting element 120 is turned on while the other light emitting element 20 is turned off.

Accordingly, the condenser lens 130 can collect light emitted from the light emitting element 120 to a position at or near the central portion of the front edge 141 of the reflecting plate 140. Part of the collected light can be reflected by the lower surface of the reflecting plate 140 near the front edge 141 of the reflecting plate 140 to the lower reflecting surface 63 of the reflector 60. Another part of the collected light can pass through the front side of the front edge 141 of the reflecting plate 140 upward to travel to the upper reflecting surface 62.

The light reflected by the lower surface of the reflecting plate 140 can be incident on the lower reflecting surface 63 and be reflected forward by the same. Then, the reflected light can travel forward below the reflecting plate 140 and the decoration plate 70. The light reflected by the lower reflecting surface 63 can be projected to an area below the H line on the virtual screen to form a bright area below the H line, and a bright-dark boundary line can be formed at the upper edge of the bright area. It should be noted that the shape of the bright-dark boundary line can be the shape obtained by vertically and horizontally reversing the shape of the front edge 141 of the reflecting plate 140 when the reflecting plate 140 is observed from the rear side.

The light passing through the front side of the front edge 141 of the reflecting plate 140 can be reflected by the upper reflecting surface 62 forward. Then, the reflected light can travel forward above the reflecting plate 140 and the decoration plate 70. The light reflected by the upper reflecting surface 62 can be projected to an area below the H line on the virtual screen to form a bright area below the H line, and a bright-dark boundary line is formed at the upper edge of the bright area. It should be noted that the shape of the bright-dark boundary line can be the shape obtained by vertically and horizontally reversing the shape of the front edge 141 of the reflecting plate 140 when the reflecting plate 140 is observed from the rear side.

In this manner, the bright areas formed by the light reflected by the upper and lower reflecting surfaces 62 and 63 can be synthesized on the virtual screen, so that the clear bright-dark boundary line can be formed at the upper edge of the synthesized bright area. Further, the shape of the bright-dark boundary line can be obtained by vertically and horizontally reversing the shape of the front edge 141 of the reflecting plate 140 when the reflecting plate 140 is observed from the rear side. Thus, the bright area B as illustrated in any of FIGS. 6 to 8 can be formed on the virtual screen.

With this vehicle lighting unit 1C alone or in combination with other lighting units, the light distribution of the bright area formed by the light emitting element 120 being turned on and 20 being turned off simultaneously can satisfy various light distribution standards for low-beam headlamps.

When a high beam should be generated, both the light emitting elements 20 and 120 are to be turned on simultaneously.

The light emitted from the light emitting element 20 can be collected by the condenser lens 30 to, or in the vicinity of, the central part of the front edge 141 of the reflecting plate 140. Part of the collected light can be reflected by the upper surface of the reflecting plate 140 near the front edge 141 of the reflecting plate 140 to the upper reflecting surface 62 of the reflector 60. Another part of the collected light can pass through the front side of the front edge 141 of the reflecting plate 140 downward to travel to the lower reflecting surface 63.

The light reflected by the upper surface of the reflecting plate 140 can be incident on the upper reflecting surface 62 and be reflected by the same forward. Then, the reflected light can travel forward above the reflecting plate 140 and the decoration plate 70. The light reflected by the upper reflecting surface 62 can be projected to an area above the H line in the virtual screen or spread vertically and horizontally around the point of origin O.

The light passing through the front side of the front edge 141 of the reflecting plate 140 can be reflected by the lower reflecting surface 63 forward. Then, the reflected light can travel forward below the reflecting plate 140 and the decoration plate 70. The light reflected by the lower reflecting surface 63 can be projected to an area above the H line in the virtual screen or spread vertically and horizontally around the point of origin O.

With this vehicle lighting unit 1C alone or in combination with other lighting units, the light distribution of the bright area formed by the light emitting elements 20 and 120 being turned on simultaneously can satisfy various light distribution standards for high-beam headlamps.

Fifth Exemplary Embodiment

Figure 12:
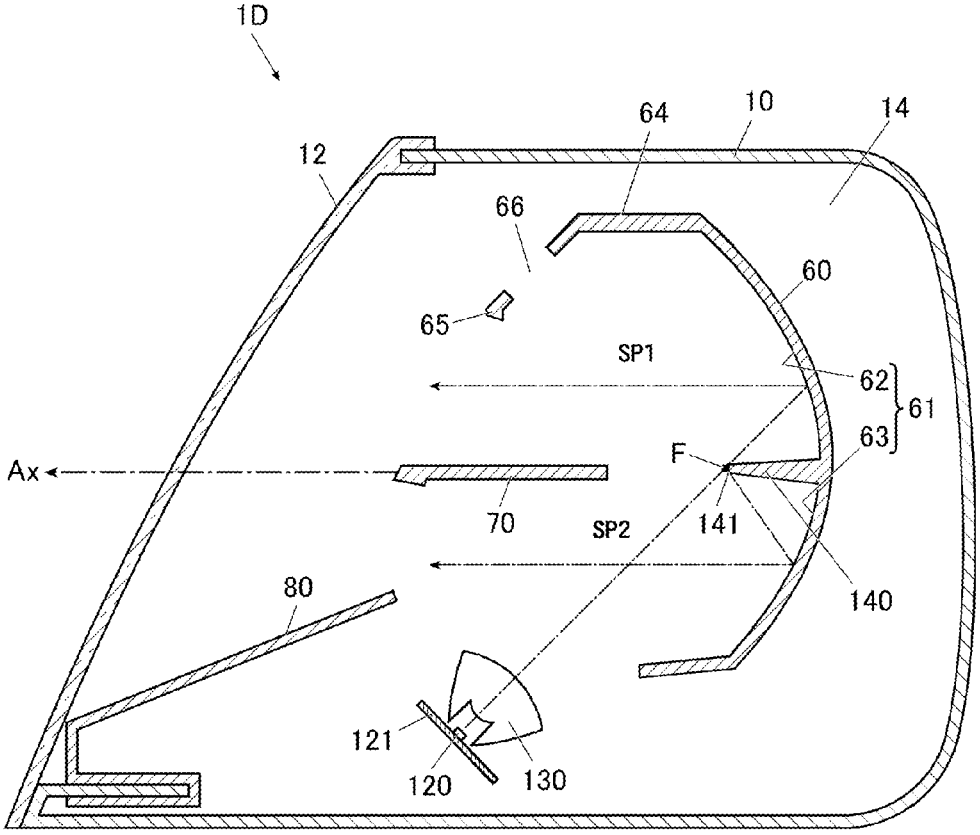
FIG. 12 is a longitudinal cross-sectional view illustrating a vehicle lighting unit according to a fifth exemplary embodiment made in accordance with the principles of the presently disclosed subject matter.

FIG. 12 is a longitudinal cross-sectional view illustrating a vehicle lighting unit 1D according to a fifth exemplary embodiment made in accordance with the principles of the presently disclosed subject matter.

In the fifth exemplary embodiment, the same or similar components of the vehicle lighting unit 1D as or to those of the vehicle lighting unit 1C of the fourth exemplary embodiment may be denoted by the same or similar reference numerals, and descriptions thereof will be omitted appropriately. Hereinafter, different points between the vehicle lighting unit 1D of the fifth exemplary embodiment and the vehicle lighting unit 1C of the fourth exemplary embodiment will be mainly described.

The vehicle lighting unit 1D can be applied to a vehicle headlamp capable of generating low beam. Specifically, the vehicle lighting unit 1D does not include the light emitting element 20, the substrate 21, and the condenser lens 30, which have been provided to the vehicle lighting unit 1C of the fourth exemplary embodiment.

With this vehicle lighting unit 1D alone or in combination with other lighting units, the light distribution of the bright area formed by the light emitting element 120 being turned on can satisfy various light distribution standards for low-beam headlamps.

Sixth Exemplary Embodiment

Figure 13:
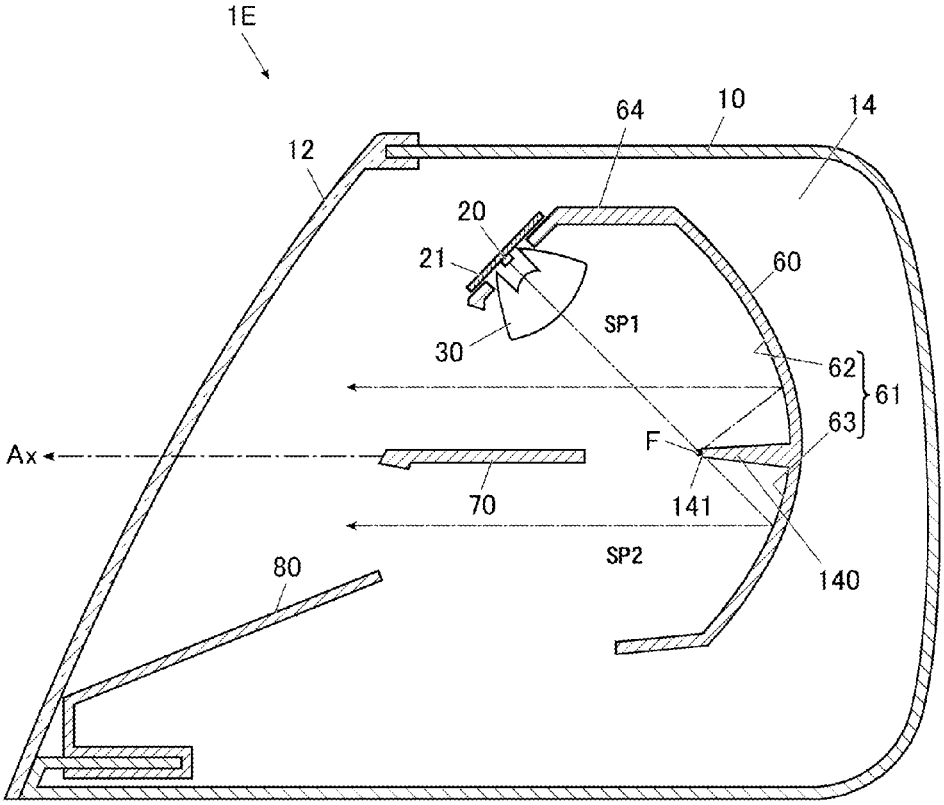
FIG. 13 is a longitudinal cross-sectional view illustrating a vehicle lighting unit according to a sixth exemplary embodiment made in accordance with the principles of the presently disclosed subject matter.

FIG. 13 is a longitudinal cross-sectional view illustrating a vehicle lighting unit 1E according to a sixth exemplary embodiment made in accordance with the principles of the presently disclosed subject matter.

In the sixth exemplary embodiment, the same or similar components of the vehicle lighting unit 1E as or to those of the vehicle lighting unit 1C of the fourth exemplary embodiment may be denoted by the same or similar reference numerals, and descriptions thereof will be omitted appropriately. Hereinafter, different points between the vehicle lighting unit 1E of the sixth exemplary embodiment and the vehicle lighting unit 1C of the fourth exemplary embodiment will be mainly described.

The vehicle lighting unit 1E can be applied to a vehicle headlamp capable of generating high beam. Specifically, the vehicle lighting unit 1E does not include the light emitting element 120 and the condenser lens 130, which have been provided to the vehicle lighting unit 1C of the fourth exemplary embodiment.

With this vehicle lighting unit 1E alone or in combination with other lighting units, the light distribution of the bright area formed by the light emitting element 20 being turned on can satisfy various light distribution standards for high-beam headlamps.

Note that the decoration plate 70, the reflecting plate 140, the light emitting element 20, the substrate 21, and the condenser lens 30 may be arranged at respective positions derived by rotating the decoration plate 70, the reflecting plate 40, the light emitting element 20, the substrate 21, and the condenser lens 30 (illustrated in FIG. 13) by 90 degrees.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit comprising:

a reflector having, as a front surface thereof, a concave reflecting surface formed on the basis of a revolved parabolic surface with respect to an optical axis extending in a front-to-rear direction of a vehicle body and serving as a rotational symmetric axis, the reflecting surface configured to have a focal point disposed on or near the optical axis;

a reflecting plate disposed to be aligned along the optical axis in front of the reflecting surface and having a front edge and a rear edge so as to divide a space in front of the reflecting surface into two upper and lower regions including a first region as the upper region and a second region as the lower region, one of the front edge and the rear edge being disposed at or near the focal point;

a first light emitting element disposed in the first region of the two regions and in front of the focal point, the first light emitting element being directed to the focal point; and a first condenser lens disposed between the first light emitting element and the focal point, the first condenser lens configured to collect light emitted from the first light emitting element to a position at or near the focal point, wherein a range within which the reflecting surface is formed is from the first region to the second region with respect to the optical axis when viewed from its front side, a part of the light collected by the first condenser lens is reflected by the reflecting plate near the front edge or the rear edge, and is directed to a first portion of the reflecting surface in the first region so as to be reflected forward by the first portion of the reflecting surface in the first region, and another part of the light collected by the first condenser lens passes before the front edge or behind the rear edge and travels to a second portion of the reflecting surface in the second region to be reflected forward by the second portion of the reflecting surface in the second region, the first light emitting element and the first condenser lens are disposed to be displaced from the optical axis of the reflecting surface, and the light from the vehicle lighting unit forms a light distribution on a virtual screen assumed to be in front of the vehicle lighting unit, the light distribution includes a bright-dark boundary line, and the bright-dark boundary line has a shape obtained by vertically and horizontally reversing a shape of the rear edge or the front edge of the reflecting plate when the reflecting plate is observed from the rear side.

2. The vehicle lighting unit according to claim 1, further comprising a decoration plate disposed to be aligned along the optical axis in front of the reflecting plate, the decoration plate configured to divide the space in front of the reflecting surface together with the reflecting plate into the two upper and lower regions.

3. The vehicle lighting unit according to claim 1, further comprising: a second light emitting element disposed in the second region and in front of the focal point, the second light emitting element being directed to the focal point; and a second condenser lens disposed between the second light emitting element and the focal point, the second condenser lens configured to collect light emitted from the second light emitting element to a position at or near the focal point, wherein a part of the light collected by the second condenser lens is reflected by the reflecting plate near the front edge or the rear edge, directed to the second portion of the reflecting surface in the second region so as to be reflected forward by the second portion of the reflecting surface in the second region, and another part of the light collected by the second condenser lens passes before the front edge or behind the rear edge and travels to the first portion of the reflecting surface in the first region to be reflected forward by the first portion of the reflecting surface in the first region.

4. The vehicle lighting unit according to claim 2, further comprising: a second light emitting element disposed in the second region and in front of the focal point, the second light emitting element being directed to the focal point; and a second condenser lens disposed between the second light emitting element and the focal point, the second condenser lens configured to collect light emitted from the second light emitting element to a position at or near the focal point, wherein a part of the light collected by the second condenser lens is reflected by the reflecting plate near the front edge or the rear edge, directed to the second portion of the reflecting surface in the second region so as to be reflected forward by the second portion of the reflecting surface in the second region, and another part of the light collected by the second condenser lens passes before the front edge or behind the rear edge and travels to the first portion of the reflecting surface in the first region to be reflected forward by the first portion of the reflecting surface in the first region.

* * * * *